US005333731A

United States Patent [19]

McCuaig

[11] Patent Number: 5,333,731

[45] Date of Patent: Aug. 2, 1994

[54] GOLF CASE FOR SEPARATE RETENTION OF CLUBS DURING TRAVEL

[76] Inventor: Kenneth W. McCuaig, 55 Oak Dr., Orinda, Calif. 94563

[21] Appl. No.: 78,453

[22] Filed: Jun. 15, 1993

[51] Int. Cl.[5] ..... A63B 55/00

[52] U.S. Cl. ..... 206/315.6; 206/315.3; 206/315.7

[58] Field of Search ..... 206/315.2, 315.3, 315.6, 206/315.7, 315.8; 248/96; 280/DIG. 6, 37

[56] References Cited

U.S. PATENT DOCUMENTS

| | | | |
|---|---|---|---|
| 646,869 | 4/1900 | Perkes | 280/DIG. 6 X |
| 1,189,879 | 7/1916 | Shamberg | 206/315.6 |
| 1,570,500 | 1/1926 | Kennedy | 206/315.6 |
| 2,047,079 | 7/1936 | MacMurray | 206/315.6 X |
| 2,070,254 | 2/1937 | Burgner | 248/96 X |
| 2,502,627 | 4/1950 | Martin | 206/315.6 |
| 2,551,009 | 5/1951 | Kaltenbach | 280/DIG. 6 X |
| 2,699,951 | 1/1955 | Gans | 280/DIG. 6 X |
| 2,726,874 | 12/1955 | Sullivan | 280/DIG. 6 X |
| 2,837,346 | 6/1958 | Chambless | 280/37 |
| 2,857,168 | 10/1958 | Neaverson | 280/DIG. 6 X |
| 2,911,228 | 11/1959 | Green | 280/DIG. 6 X |
| 3,204,976 | 9/1965 | Sprigley | 280/37 |
| 3,779,297 | 12/1973 | Stammer | 206/315.6 |
| 4,836,565 | 6/1989 | Catalo | 280/37 |
| 4,858,761 | 8/1989 | Fumia | 206/315.3 |
| 4,863,019 | 9/1989 | Lewis et al. | 206/315.13 |
| 5,060,796 | 10/1991 | Brooks, III | 206/315.6 |
| 5,069,481 | 12/1991 | Strange | 280/769 |
| 5,071,147 | 12/1991 | Stansbury | 280/47.19 |
| 5,168,992 | 12/1992 | Bowdy | 206/315.6 |

FOREIGN PATENT DOCUMENTS

| | | | |
|---|---|---|---|
| 214555 | 8/1967 | Sweden | 206/315.6 |
| 733631 | 7/1955 | United Kingdom | 280/DIG. 6 |
| 1295246 | 11/1972 | United Kingdom | 206/315.2 |

*Primary Examiner*—Sue A. Weaver
*Attorney, Agent, or Firm*—Schneck & McHugh

[57] ABSTRACT

A case for presenting a set of golf clubs includes first and second rigid doors which each include a bar mechanism that holds the doors in a play position and a lock position. In the play positions, the bar mechanisms are interconnected to fix the doors at a selected angle to each other. In lock positions, each bar mechanism applies a compressive force against a portion of a set of golf clubs that are maintained in generally parallel side-by-side relationship. Each bar mechanism includes an elastomeric member that is brought into contact with the club shafts, so that the bar mechanism deforms to provide force along the shaft from a range of angles. A support structure maintains the clubs in parallel relationship when the bar mechanisms are moved to the play positions.

15 Claims, 5 Drawing Sheets

GOLF CASE FOR SEPARATE RETENTION OF CLUBS DURING TRAVEL

TECHNICAL FIELD

The present invention relates generally to carrying devices for golf clubs and more particularly to containers for use in both transporting clubs and presenting clubs in a desired configuration during play.

BACKGROUND ART

Conventional golf bags function well for their intended purpose of storing the clubs during golf play. However, the shape of the bag and the manner in which the clubs protrude from the bag are less than optimal for purposes of storing and transporting the golf clubs. Moreover, the cylindrical sides are typically made of a flexible material, e.g., leather or vinyl, that does not provide the desired protection to golf clubs during airline, bus or truck travel- Bag covers prevent individual clubs from sliding from the bag during shipment or travel, but typically such covers do not protect golf clubs from damage resulting from forcible impact, including axial forces that may be encountered during travel as the golf bag is handled and stored as baggage. Such axial compression will potentially damage the golf clubs, including the hosel area.

U.S. Pat. No. 5,071,147 to Stansbury describes a club-carrying device that provides an increased degree of protection. The device includes a rigid housing having a rectangular cross section and having a forwardly angled open top that is hinged at a rearward edge to a lid. Shafts of the clubs are protected by the housing, and closing the lid will completely cover the heads of the clubs. The device significantly increases protection of the golf clubs, but the device is large and difficult to carry.

In addition to protecting clubs, another consideration in the design of a golf bag is the presentation of clubs during golf play. U.S. Pat. Nos. 4,836,565 to Catalo and 5,168,992 to Bowdy describe golf club carriers in which at least some of the clubs are held with the club heads facing downwardly. Because it is difficult to distinguish individual clubs when the clubs are stored in a head-down position, the club presentation provided by these carriers is less than ideal.

Another aspect to proper club presentation is the accessibility of clubs when the club carrier is joined to a golf cart, such as a motorized golf cart. Carts are constructed to accommodate conventional golf bags. Any improvement to club transportation must take into account the space allocations on a golf cart and the means for attaching the club carrier to the golf cart.

An object of the present invention is to provide a club-carrying case which, during play, can be easily attached to a conventional motorized golf cart such that the clubs are presented in a position to facilitate identification, and which, during transportation, provides protection against the rigors of airline, bus and trucking travel and shipment.

SUMMARY OF THE INVENTION

The above object has been met by a club-carrying case in which first and second bar mechanisms are utilized during golf play to retain first and second rigid doors at a desired angle for proper club presentation. Moreover, the bar mechanisms are used during transportation and storage to laterally and vertically immobilize golf clubs. One portion of a set of golf clubs is supported in an inverted condition along an inner major surface of the first door, so that the club heads are directed upwardly for easy identification. In like manner, the remainder of the set of clubs is supported in an inverted condition along an inner major surface of the second door. The golf clubs along each door have a parallel, side-by-side orientation.

In a preferred embodiment, the side-by-side relationship of the golf clubs along a door is maintained during golf play without the aid of the bar mechanism. Instead, the bar mechanism of the first door is connected to the bar mechanism of the second door to fix the doors at a desired angle. The choice of angle may be a function of a number of considerations, such as space allocated for a golf bag on a motorized golf cart. The angle should be selectable. For example, the first bar mechanism may include hook material that is releasably connected to loop material on the second bar mechanism.

Ends of the first and second bar mechanisms are pivotally attached to outer walls of the first and second doors. In the play mode, the opposite ends of the bar mechanisms are connected to one another. However, when the case and golf clubs are to be transported, the bar mechanisms are detached from one another and the ends are fixed to inner walls of the first and second doors. The first bar mechanism, for example, extends along the interior of the case from the outer wall to the inner wall of the first door. The position of the first bar mechanism relative to the major inner surface of the first door is such that a compressive force is applied to the side-by-side golf clubs to prevent lateral and vertical displacement of the clubs.

An elastomeric member extends from the bar mechanism to apply the compressive force, thereby reducing the risk of scratching the shafts of the clubs. The attachment of the bar mechanism to the inner wall of the first door may be accomplished by means of a channel that receives the end of the bar mechanism, with the channel preferably being configured to induce rotation of the bar mechanism in order to achieve a mechanical advantage. The second bar mechanism functions in the same manner as the first bar mechanism.

The major inner surface of each door includes a raised region that is spaced apart from the associated bar mechanism. Four points of contact between the clubs and the major inner surface are thereby achieved. In addition to contact at the grip end of the club and at the bar mechanism along the shaft of the club, contact is made at the club head and at the interface of the raised region with the club shaft. The raised region is preferably a pliable member that is sufficiently small to ensure that clubs are not bent beyond an elastic limit by the application of the compressive force of the bar mechanisms.

An advantage of the present invention is that the case provides sufficient rigidity to protect clubs against damage caused by handling during travel. Moreover, the configuration and the dimensions of the case permit the case to be stored in an overhead compartment of an aircraft. Once a golfing destination is reached, a golfer is able to use the case during play. The adjustment of the relative position of the two doors allows the case to be secured in position within space allocated for golf bags on motorized carts and the like.

BEST MODE FOR CARRYING OUT THE INVENTION

Figure 1:
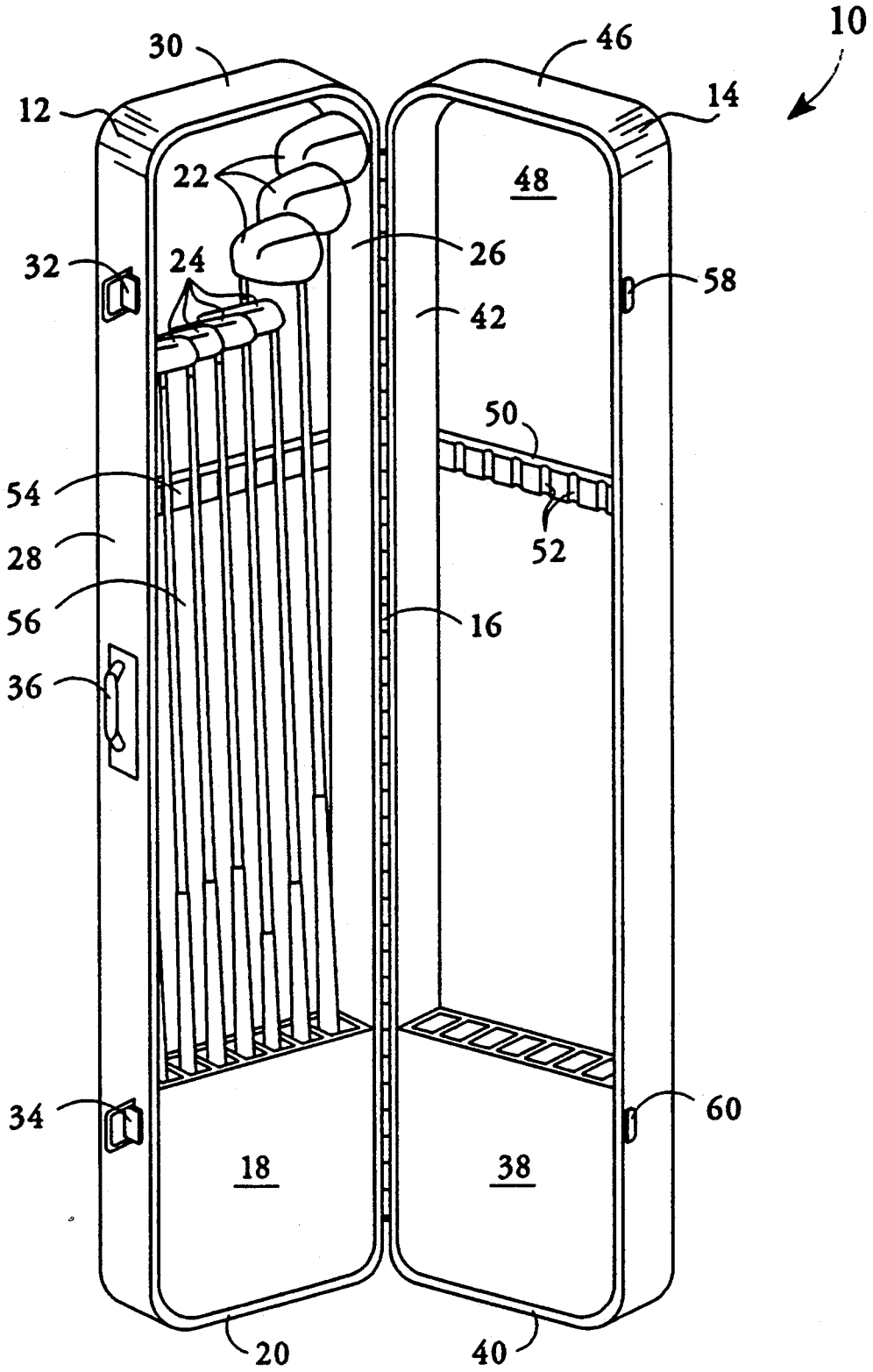
FIG. 1 is a perspective view of a golf case having a first portion of a set of golf clubs supported in an inverted condition in accordance with the present invention.

With reference to FIG. 1, a golf case 10 is shown as including a first door 12 and a second door 14 joined together at a hinge 16. The case is made of a rigid material that is able to withstand an impact of the type to be expected during shipment and travel. A suitable material is a hard-shell ABS plastic. The golf case is preferably lined with extruded aluminum valances to further strengthen the case.

The first door includes a segmented support 18 at a bottom wall 20. The segmented support 18 maintains seven golf clubs 22 and 24 in inverted side-by-side relationship. In the preferred embodiment, the segmented support independently maintains this relationship. That is, no other structure is required to secure the clubs 22 and 24 when the golf case 10 is in the upright position of FIG. 1.

In addition to the bottom wall 20, the first door 12 includes an inner wall 26, an outer wall 28 and a top wall 30. The outer wall includes a pair of latches 32 and 34, as well as a handle 36. While the handle is shown as being centered along the outer wall, typically the center of gravity will be closer to the top wall 30 when the clubs are inserted, so that the handle 36 should be adjusted accordingly.

The United States Golf Association rules limit a player to fourteen clubs during a round of golf. The case 10 may be used to carry seven clubs 22 and 24 in a single door 12, but preferably the second door 14 is also equipped to carry seven clubs. Similar to the first door, the second door 14 includes a segmented support 38 and bottom, inner, outer and top walls 40, 42, 44 and 46, respectively. The segmented support 38 is structured to independently maintain seven clubs in an inverted condition. A major inner surface 48 of the second door includes a raised region 50 to contact the shafts of the golf clubs. The raised region is shown as having detents 52 aligned to receive the club shafts. However, the detents are optional. The raised region may be a strip of foam that is adhere to the major inner surface 48 behind a cloth which lines the major inner surface. The first door 12 also includes a raised region 54 along a major inner surface 56.

The outer wall 44 of the second door 14 includes catches 58 and 60 aligned for coupling to the latches 32 and 34 on the outer wall 28 of the first door 12. At the inner walls 26 and 42 of the doors, the hinge 16 is attached to allow the doors to swing with respect to one another.

Figure 2:
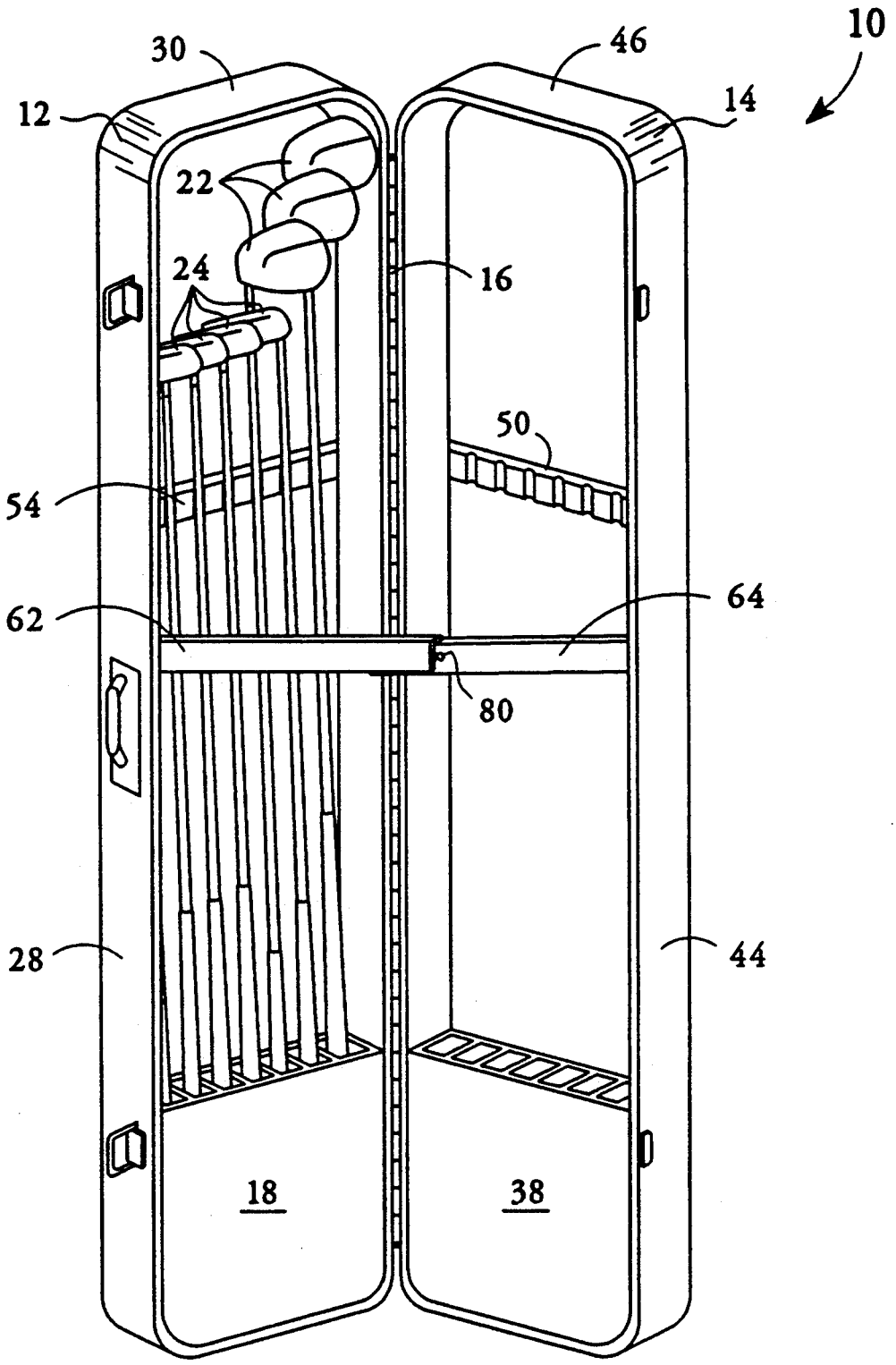
FIG. 2 is a perspective view of the golf case of FIG. 1 with first and second bar mechanisms securing hinged doors at a fixed angle.

Shown in FIG. 2 are first and second bar mechanisms 62 and 64 that selectively secure the doors 12 and 14 at a fixed angle to each other. Preferably, the first bar 62 is attached to the second bar 64 in a manner that permits adjustment of the selected angle. For example, the first bar mechanism 62 may have hook material, while the second bar mechanism includes loop material of the type sold under the trademark VELCRO by Velcro Inc. Alternatively, a pin arrangement may be used to relocate a pin of the first bar mechanism to any one of a series of holes, not shown, in the second bar mechanism. Other arrangements are available.

The bar mechanisms 62 and 64 are attached to form an angle that depends upon playing conditions. For example, if the golf case 10 is to be positioned within a motorized golf cart, the attachment of the bar mechanisms may depend upon the space allocated upon the golf cart for a club-carrying container- The bar mechanisms provide a means for varying the space required by the golf case. An important feature of the use of the bar mechanisms is that there is no interference with the insertion and removal of the golf clubs 22 and 24. This is in contrast to pivoting bracket devices extending between walls such as top walls 30 and 46. The pivoting bracket devices would add an obstacle for removal of longer clubs, such as the woods 22.

Figure 3:
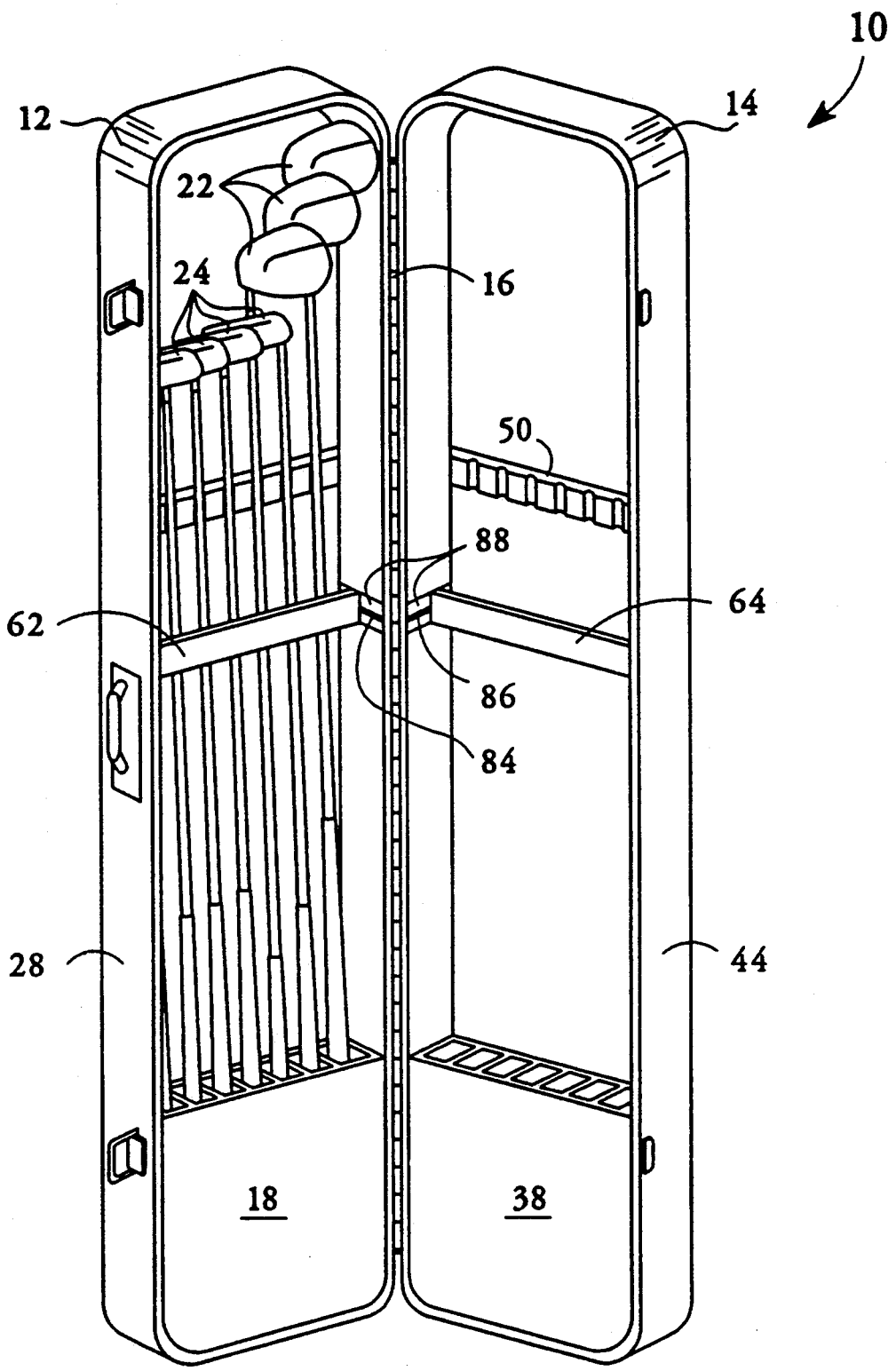
FIG. 3 is a perspective view of the golf case of FIG. 2, wherein the bar mechanisms are fixed in locked positions to immobilize the golf clubs.

FIG. 2 illustrates the bar mechanisms 62 and 64 in play positions. With the bar mechanisms in these positions, the clubs are accessible for removal and insertion. At the conclusion of a round of golf, a player detaches the first bar mechanism from the second bar mechanism and then attaches each bar mechanism in a lock position shown in FIG. 3. In this position, the first bar mechanism 62 provides a compressive force onto the shafts of the clubs 22 and 24. While not shown, preferably the heads of the clubs 22 and 24 are separated from one another before the bar mechanisms are pressed into place. The force exerted on the shafts is sufficient to laterally and vertically immobilize the clubs regardless of whether the club shafts are fully received within the segmented support 18.

The operation of the bar mechanisms 62 and 64 can be best seen by referring to FIGS. 2–5. In the play position, the hook and loop arrangement 66 and 68 of FIG. 5 secures the doors 12 and 14 in a fixed open condition. Preferably, the hook material 66 on the first bar mechanism 62 and/or the loop material 68 on the second bar mechanism 64 extends along the entire length, so as to allow a greater flexibility in the selection of the open angle.

Each of the bar mechanisms 62 and 64 includes a pivot ball 70 and 72 that comprise a portion of a ball-and-socket arrangement. The ball-and-socket arrangements allow the bar mechanisms 62 and 64 to be swiveled with respect to outer door walls 28 and 44 to which the bar mechanisms are attached- Thus, the bars can be freely swiveled from the play positions of FIG. 2 to the lock positions of FIG. 3.

The pivot ball 70 at the end of first bar mechanism 62 is received within an opening 76 in a bracket 74 that defines the socket of the ball-and-socket arrangement. The opening 76 allows a neck region 78 to pass therethrough, but prevents passage of the pivot ball itself. The bracket 74 is affixed to the inside of the outer wall 28. A similar bracket is attached to the inside of the second door 14 to define a socket for the pivot ball 72 of the second bar mechanism 64.

Figure 4:
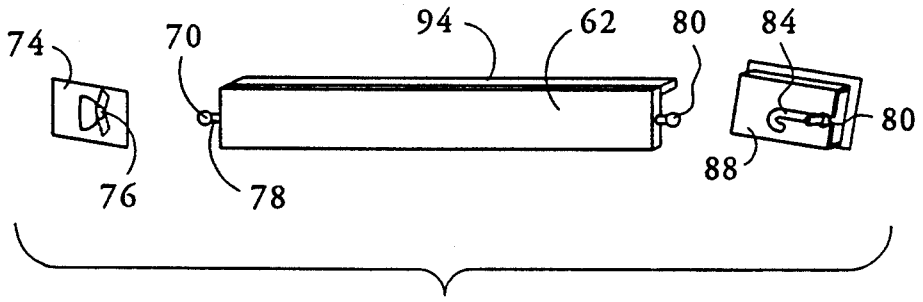
FIG. 4 is an exploded view of the arrangement of the bar mechanism and its retaining hardware.
Figure 5:
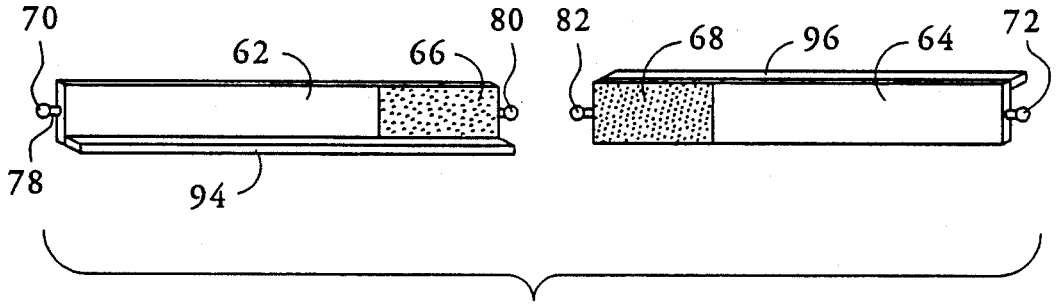
FIG. 5 is a perspective view of the two bar mechanisms of FIG. 3.

At the opposite ends of the bar mechanisms 62 and 64 are channel protrusions 80 and 82. The channel protrusions play no role when the bar mechanisms are in the play position shown in FIG. 2. However, the channel protrusions extend into bracket channels 84 and 86 when the bar mechanisms are in the lock positions shown in FIG. 3. The operation is best seen in FIG. 4. A channel protrusion 80 is received within a channel 84 of a bracket 88. The configuration of the channel is such that the protrusion is locked in position when the entire path of the channel has been traversed. Preferably, the configuration of the channel causes some rotation of the bar mechanism 62, thereby achieving a mechanical advantage to the compression of the bar mechanism against the shafts of the golf clubs 22 and 24.

Each of the first and second bar mechanisms 62 and 64 includes an elastomeric member 94 and 96. The elastomeric members are positioned to contact the shafts of the golf clubs 22 and 24 when the bar mechanisms are in the lock positions. In addition to reducing the risk of scratching the shafts, the elastomeric members provide a degree of deformation of the bar mechanisms in order to provide a force on the shafts from a range of angles. Thus, the lateral movement of the clubs is restricted by the deformation.

Figure 6:
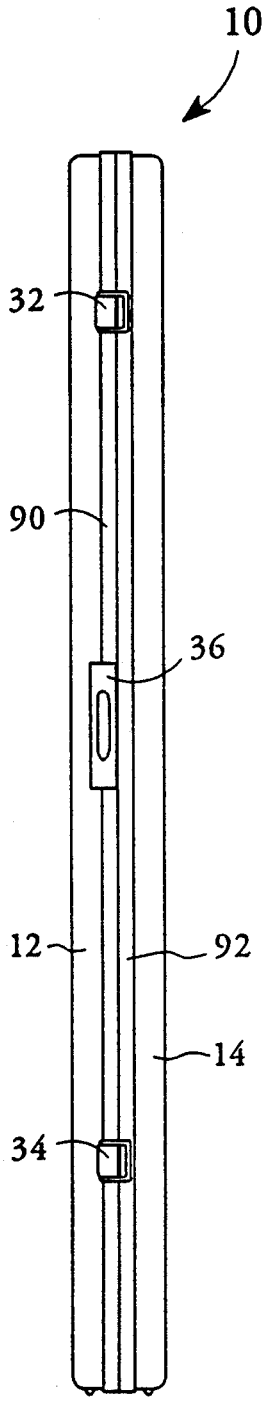
FIG. 6 is an end view of the golf case of FIG. 1.
Figure 7:
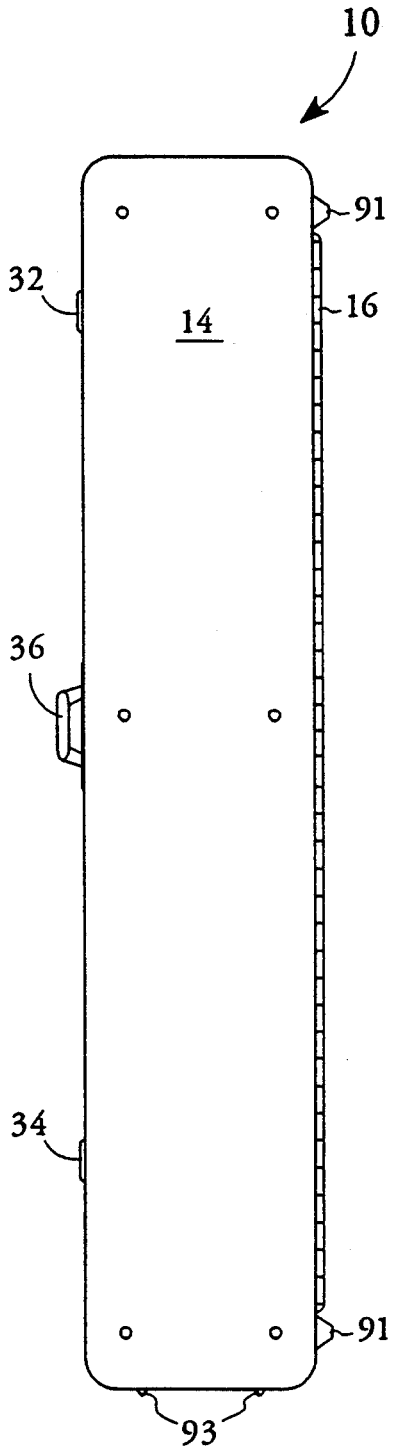
FIG. 7 is a side view of the golf case of FIG. 6.

Referring now to FIGS. 6 and 7, the golf case 10 is shown in a closed position. While not critical, the length of the golf case may be 47.5 inches, allowing the case to be stored in a typical overhead compartment of an aircraft. With respect to the front view of FIG. 6, a suitable side-to-side dimension is 4.0 inches. Aluminum valances 90 and 92 can be seen in FIG. 6. With regard to the side view of FIG. 7, a typical lateral dimension may be 10.1 inches. The case includes feet 91 and 93 on which the case will rest when it is placed on the case bottom or on the side of the case having the hinge 16.

In operation, when a player is ready to use the golf case 10, the case is opened to a desired angle and the first and second bar mechanisms 62 and 64 are interconnected in the manner shown in FIG. 2. The case is secured to a golf cart using standard cart straps. The clubs 22 and 24 are then available for play and are presented in a manner that facilitates club identification. The clubs are maintained in the side-by-side relationship by means of the segmented support 18.

Optionally, the golf clubs 22 and 24 are not fully supported by the support segment 18. For example, the bar mechanisms 62 and 64 may have a play position in which the bar mechanisms are moved slightly rearward of the lock position shown in FIG. 3, thereby releasing the clubs for play but simultaneously providing a surface against which the clubs lie. In this embodiment of a play position for the bar mechanisms, the clubs will rest at an angle relative to the golf case 10. The angle will depend upon the degree of movement of the bar mechanisms from a lock position to a play position. The channels 84 and 86 of the brackets 88 should be reconfigured to prevent escape of the associated bar mechanism. While this embodiment is possible, the above-described embodiment in which the bar mechanisms lock the first and second doors 12 and 14 at a fixed angle is preferred.

Figure 8:
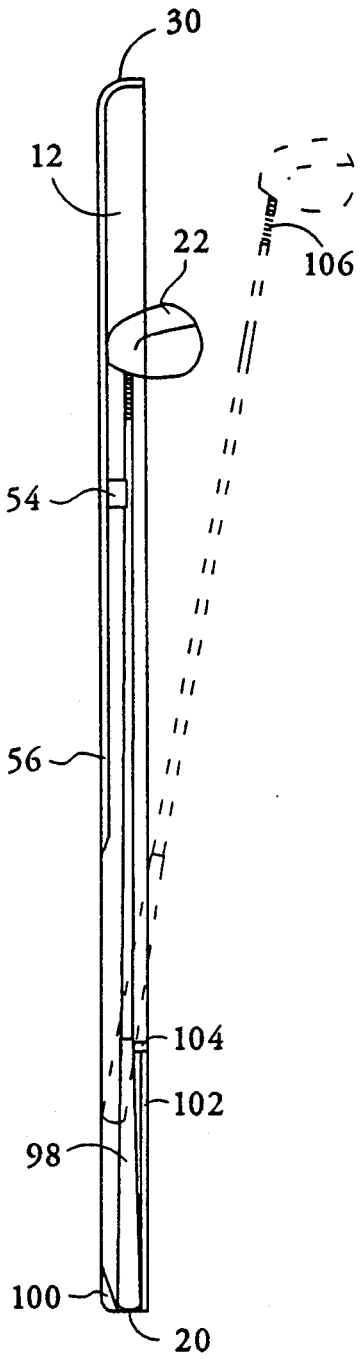
FIG. 8 is a side view of the operation of a second embodiment of a club support structure of one door of the golf case of FIG. 1.

A second embodiment of a support structure for a golf club 22 is shown in FIG. 8. A grip 98 of the club rests against the bottom wall 20 of the first door 12. A sloped surface 100 prevents rearward motion of the grip, while a vertical member 102 restricts the forward motion of the grip. Thus, the club remains in an upright position by a combination of gravitational force and the configuration of the walls.

If a club is longer than the one illustrated in FIG. 8, proper clearance of the top wall 30 becomes an important concern. The support must capture and organize golf clubs when not in use, but must also allow quick and easy access during removal, without bending of the clubs. These objectives are met by including a horizontal bar 104 extending parallel to the width of the first door 12. Ideally, the horizontal bar contacts the grip 98 or shaft of the golf club 22. Consequently, there will be points of contact with the club at the bottom wall 20, the horizontal bar 104, the raised region 54 and at the interface of the club head and the major inner surface 56. For purposes of illustration, only a top portion of the major inner surface is shown. As the club is moved upwardly, the club will slide along the points of contact with the horizontal bar 104, the raised region and the club head, but only a small degree of movement is necessary to free the grip 98 from contact with the sloped surface 100. The club 22 can then be pivoted forwardly, using the horizontal bar 104 as the pivot axis. Further upward movement increases the degree of pivot freedom. FIG. 8 illustrates a pivoted club 106 in phantom. Insertion of the golf club is accomplished by using the same pivoting action.

Figure 9:
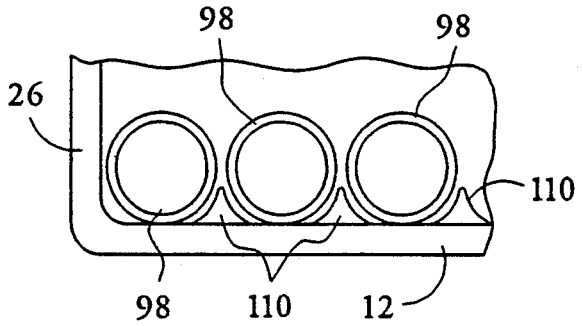
FIG. 9 is a top view of the golf support structure of FIG. 8.

In FIG. 9, the shafts 98 of the golf clubs are shown as being located between inverted V-shaped members 110. The configuration of the members permits easy acceptance of the grips 98. Although the V-shaped members are configured to prevent one golf grip from riding into the adjacent channel that is assigned to retain another golf grip, the dimensions of the V-shaped members allow the grips to contact one another. This contact allows a reduction of the widths of the case doors 12, as compared to the segmented support 18 shown in FIG. 1. The segmented support of FIG. 1 includes partitions that must be factored into the determination of the width of the case 10. By utilizing the embodiment of FIG. 9, the grips 98 can be held securely without the aid of partitions. Consequently, the width can be reduced to nine inches.

While not shown, a plate can extend perpendicularly from the wall 26 of FIG. 9 at a sufficient distance from the grips 98 and the inverted V-shaped members 110 to allow contact between adjacent club grips, while preventing one grip from entering the channel of another grip. Alternatively, the horizontal bar 104 of FIG. 8 may be used in place of the plate. Optionally, the horizontal bar 104 may be spring-loaded to provide a bias in the direction of the clubs. Because grips vary in diameter, shims may be added to the structure of FIG. 9 to ensure proper support of clubs having smaller grips 98.

Other segmented supports may be utilized. For example, brushes or other pliable structures may be added to each of the segments of the segmented supports 18 and 38 of FIG. 2 in order to apply a pressure to the club grips to accomplish the support while allowing easy removal and insertion. However, it has been discovered that the fixed support structure of FIGS. 8 and 9 is more reliable and reduces manufacturing complexities.

We claim:

1. A case for transporting a set of golf clubs and for presenting said golf clubs during play comprising:

a first door;

a second door;

means for pivotally connecting said second door to said first door, said first and second doors each having a major inner surface, said first and second doors having a closed condition in which an enclosed chamber is defined between said inner major surfaces of said first and second doors;

first support means coupled to said first door and second support means coupled to said second door for supporting a plurality of golf clubs aligned in parallel side-by-side relationship along said major inner surfaces;

a first bar mechanism operatively associated with said first door and a second bar mechanism operatively associated with said second door, each of said bar mechanisms having a play position in which said first and second doors are open and having means for selectively fixing said bar mechanism in a lock position, each bar mechanism disposed to apply a compressive force on said side-by-side golf clubs when said bar mechanism is in said lock position, displacement of each of said bar mechanisms from said lock position to said play position spacing apart said bar mechanism from said major inner surface to which the bar mechanism is operatively associated by a distance sufficient to permit removal and insertion of said side-by-side golf clubs, each bar mechanism having a first end and a second end;

means for securing said second end of each bar mechanism to the respective first and second door with which said bar mechanism is operatively associated; and means coupled to said first and second bar mechanisms for selectively fixing together said first and second bar mechanisms at regions of said bar mechanisms spaced apart from said second ends when said bar mechanisms are in said play positions, wherein said first and second doors are selectively secured in an open condition at a selected angle by said means for fixing together said bar mechanisms.

2. The case of claim 1 wherein said means for fixing together said bar mechanisms includes hook material on said first bar mechanism and loop material on said second bar mechanism.

3. The case of claim 1 wherein said means for securing said second ends of said first and second bar mechanisms to said first and second doors includes structure to allow said bar mechanisms to pivot relative to said first and second doors and wherein said second ends include projections dimensional to be removably secured within channels of said first and second doors.

4. The case of claim 3 wherein said channels are elongated guides configured to slidably receive said projections, said elongated guides having curved regions to induce axial rotation of said bar mechanisms relative to said first and second doors as said projections slide along said curved regions with displacement of said bar mechanisms from said play position to said lock position.

5. The case of claim 1 wherein said first and second support means are each configured to receive grip ends of said side-by-side golf clubs, thereby supporting said side-by-side golf clubs in an inverted condition when said bar mechanisms are in said play position.

6. The case of claim 5 wherein each inner major surface has a raised region in spaced relation to said bar mechanisms and said first and second support means, each of said side-by-side golf clubs having force points of contact, with one point of contact each at said support means, at said bar mechanism, at said raised region and at a head of said side-by-side golf club.

7. A case for transporting a set of golf clubs and for presenting said golf clubs during play comprising:

first and second case segments;

means for pivotally coupling said first and second case segments, said first case segment having a major side and having minor sides extending from said major side to define an interior, said major side having a bottom end and a top end;

club-grip means coupled to said first case segment for supporting a plurality of golf clubs in inverted, generally parallel orientation when said first case segment is rested on said bottom end;

a club locking device having a first end attached to said first case segment, said club locking device having a second end having means for selectively connecting said club locking device to either one of said first and second case segments, said club locking device being positioned to contact each golf club supported by said club-grip means when said second end is connected to said first case segment; and releasable means connected to said second case segment for selectively fixing said second case segment in position relative to said club locking device wherein said first and second case segments are in a fixed open condition.

8. The case of claim 7 further comprising a second club-grip means coupled to said second case segment for supporting a second plurality of golf clubs, said case further comprising a second club locking device having a first end attached to said second case segment.

9. The case of claim 7 wherein said club locking device includes an elastomeric member disposed to apply a force on said golf clubs when said second end of said club locking device is connected to said first case segment.

10. A case for transporting a set of golf clubs and for presenting said golf clubs during play comprising:

a rigid first door having first grip-contacting means for supporting golf clubs in an inverted condition;

a rigid second door having second grip-contacting means for supporting golf clubs in an inverted condition, each of said first and second doors having a major wall and having opposed inner and outer walls and opposed top and bottom walls, said inner walls of said first and second doors being joined at a hinge;

a set of golf clubs extending in generally parallel fashion along said major walls, a first portion of said golf clubs having grip ends supported by said first grip-contacting means, a second portion of said golf clubs having grip ends supported by said second grip-contacting means;

first and second bars;

first means for pivotally connecting said first bar to said outer wall of said first door;

second means for pivotally connecting said second bar to said outer wall of said second door;

means for releasably connecting said first bar to said second bar, wherein said first door is at a fixed angle relative to said second door when said first bar is connected to said second bar and wherein said first door is free to pivot with respect to said second door when said first bar is released from said second bar; and means for locking said first and second bars in compression contact with said first and second portions of golf clubs when said first bar is released from said second bar, thereby inhibiting movement of said golf clubs.

11. The case of claim 10 wherein said means for releasably connecting said first bar to said second bar includes hook material on said first bar and loop material on said second bar.

12. The case of claim 10 further comprising a handle on the exterior of said first door for carrying said case.

13. The case of claim 10 wherein said means for locking said first and second bars includes a channel at each of said inner walls of said first and second doors, said first and second bars configured to be releasably received within said channels.

14. The case of claim 10 wherein each major wall includes a raised region to contact shafts of said golf clubs, each of said first and second bars being disposed in an area between said raised regions and said grip-contacting means.

15. A case for transporting a set of golf clubs and for presenting said golf clubs during play comprising;

a first door;

a second door;

means for pivotally connecting said second door to said first door, said first and second doors each having a major inner surface, said first and second doors having a closed condition in which an enclosed chamber is defined between said inner major surfaces of said first and second doors;

first support means coupled to said first door and second support means coupled to said second door for supporting a plurality of golf clubs aligned in parallel side-by-side relationship along said major inner surfaces;

a first bar mechanism operatively associated with said first door and a second bar mechanism operatively associated with said second door, each of said bar mechanisms having a play position in which said first and second doors are open and having means for selectively fixing said bar mechanism in a lock position, each bar mechanism disposed to apply a compressive force on said side-by-side golf clubs when said bar mechanism is in said lock position, displacement of each of said bar mechanisms from said lock position to said play position spacing apart said bar mechanism from said major inner surface to which the bar mechanism is operatively associated by a distance sufficient to permit removal and insertion of said side-by-side golf clubs, each bar mechanism having a first end and a second end; and means for securing said second end of each bar mechanism to the respective first and second door with which said bar mechanism is operatively associated;

wherein each of said first and second bar mechanisms includes an elastomeric member fixed thereto and located to apply said compressive force to said side-by-side golf clubs.

* * * * *